US007063229B2

(12) United States Patent
Westerhof et al.

(10) Patent No.: US 7,063,229 B2
(45) Date of Patent: Jun. 20, 2006

(54) SINGLE HANDED CONTAINER FOR MIXING FOODS

(75) Inventors: David J. Westerhof, Battle Creek, MI (US); Brian Bone, St. Louis, MO (US); Heath Doty, St. Louis, MO (US); Marc Hunter, Clayton, MO (US); Kent Ritzel, Waterloo, IL (US)

(73) Assignee: Kellogg Company, Battle Creek, MI (US)

( * ) Notice: Subject to any disclaimer, the term of this patent is extended or adjusted under 35 U.S.C. 154(b) by 335 days.

(21) Appl. No.: 10/348,315

(22) Filed: Jan. 21, 2003

(65) Prior Publication Data

US 2003/0157224 A1 Aug. 21, 2003

Related U.S. Application Data

(63) Continuation-in-part of application No. 09/617,676, filed on Jul. 14, 2000, now Pat. No. 6,528,105.

(51) Int. Cl.
*B65D 1/24* (2006.01)

(52) U.S. Cl. ..... 220/506

(58) Field of Classification Search ..... 220/506, 220/23.86, 23.87, 4.26; 22/143, 145.3, 145.1, 22/129.1

See application file for complete search history.

(56) References Cited

U.S. PATENT DOCUMENTS 2,738,890 A 3/1956 Dahl et al. ..... 215/6
2,963,194 A 12/1960 Brennan et al. ..... 220/23.83
3,288,344 A 11/1966 Woollen et al. ..... 229/7
3,450,254 A 6/1969 Miles ..... 206/46
3,561,664 A 2/1971 Palmer ..... 229/15
3,856,138 A 12/1974 Maekawa et al. ..... 206/221
3,915,296 A 10/1975 Spencer ..... 206/217
3,978,232 A 8/1976 Dodsworth et al. ..... 426/115
4,018,904 A 4/1977 Muraoka ..... 426/115
4,277,000 A 7/1981 Jaarsma ..... 222/142.4
4,482,047 A 11/1984 Ackermann et al. ..... 206/219
4,483,439 A 11/1984 Steigerwald et al. ..... 206/219
4,582,197 A 4/1986 Lin ..... 206/217

(Continued)

*Primary Examiner*—Stephen Castellano
(74) *Attorney, Agent, or Firm*—William H. Honaker

(57) ABSTRACT

The present invention is a container for dispensing two foods simultaneously, such as for example a beverage, such as milk, and a particulate food, such as cereal. The container has an outer cup, an inner cup that fits in the outer cup forming a space between the two and a lid to close the outer cup and hold the inner cup in the outer cup. The outer cup is adapted to hold a beverage in the space between the outer cup and the inner cup. The inner cup is adapted to hold a food product. The outer cup is ergonomically shaped to fit well in a user's hands. The inner cup has a plurality of walls to facilitate the flow of food from the inner cup. The walls define a cavity that is generally v-shaped having a discharge side which is narrower than the opposite side of the cavity. The lid of the preferred embodiment has a raised rim with a small discharge opening in fluid communication with the space between the inner and outer cups. The raised rim has a slope with the highest point being at the discharge opening. The raised rim also defines a generally v-shaped opening in communication with the cavity of the inner cup. The slope of the raised rim and the v-shaped opening allow the container to be tilted without the user's head being tilted.

17 Claims, 7 Drawing Sheets

U.S. PATENT DOCUMENTS

| | | | | |
|---|---|---|---|---|
| 4,869,912 | A | 9/1989 | McCoy et al. | 426/123 |
| 4,928,848 | A | 5/1990 | Ballway | 220/444 |
| 4,993,595 | A * | 2/1991 | Bertram et al. | 222/129 |
| 5,209,348 | A | 5/1993 | Schafer, III | 206/222 |
| 5,215,214 | A | 6/1993 | Lev et al. | 222/1 |
| 5,318,183 | A | 6/1994 | Cohen et al. | 206/538 |
| 5,437,381 | A | 8/1995 | Herrmann | 215/11.1 |
| 5,496,575 | A | 3/1996 | Newarski | 426/115 |
| 5,588,561 | A | 12/1996 | Ness | 222/129 |
| RE35,437 | E | 2/1997 | Ascone | 62/372 |
| 5,676,244 | A | 10/1997 | Green et al. | 206/221 |
| 5,706,980 | A | 1/1998 | Dickerson | 222/129 |
| 5,727,679 | A | 3/1998 | Newarski | 206/222 |
| 5,753,289 | A | 5/1998 | Ness | 426/394 |
| 6,085,927 | A | 7/2000 | Kusz | 220/23.87 |
| 6,264,068 | B1 | 7/2001 | Ours et al. | 222/129 |

* cited by examiner

SINGLE HANDED CONTAINER FOR MIXING FOODS

This application is a continuation-in-part of Ser. No. 09/617,676 filed Jul. 14, 2000, now U.S. Pat. No. 6,528,105.

BACKGROUND

Convenience foods are very popular with consumers. Typically convenience foods are defined as foods that can be eaten with one hand while on the run, are easily disposable, and have little or no clean-up and mess. On the run is generally considered to be while driving a car, walking, camping, etc. With this definition, a beverage and particulate food, such as for example cereal and milk, is typically not considered to be a convenience food since it normally cannot be eaten while driving, walking etc., normally requires a bowl and spoon and can be messy to eat on the run.

In a move to make breakfast consumption more convenient, to make it a convenience type food, many manufacturers have offered breakfast bars, breakfast sandwiches and other breakfast foods which can be consumed with a single hand. There have also been several attempts to construct a container which stores cereal and milk separately, allows the two to be mixed when consumed and allows the consumer to eat the mixture with a single hand.

U.S. Pat. Nos. 5,588,561 and 5,753,289, issued to Ness, describe a container for holding cereal and milk in separate compartments. Cereal is placed in the inner, inflexible container, while milk is placed in the outer flexible container. Cereal is shaken from the inner, inflexible container into the consumer's mouth and the consumer then squeezes the outer flexible container to squirt milk into the consumer's mouth. In this manner, the cereal and the milk are mixed inside the consumer's mouth. The Ness patents require rotation of the portable food container to a dispensing position before the consumer can use the product. A need exists for a simplified single-handed container, which will allow an individual to consume cereal and milk or other beverage and food combinations with a single hand while walking, hiking, camping, driving, etc.

U.S. Pat. No. 6,264,068, assigned to the assignee of the present invention, describes various embodiments of a one-handed container for dispensing a particulate solid food and a liquid. The containers described in the '068 patent have two compartments separated by a partition. One compartment contains particulate solid food and the other contains a liquid. Dispensing of the solid food and liquid is regulated by use of one hand.

In most embodiments, the liquid is dispensed by sucking on a straw and the particulate solid food is dispensed by tilting the container to allow the food to flow from the container. In many of these embodiments, the liquid is dispensed from one side of the container, the container is then turned and the particulate solid food dispensed from the opposite side. In all these embodiments, the liquid and particulate solid food are dispensed separately.

In the embodiment shown in FIGS. 6A and 6B, the container has a shell composed of flexible material. The partition is sloped to promote pouring of the particulate solid food and to help the liquid in the other compartment from spilling. When the shell is squeezed, the edge of the partition is displaced to allow liquid to flow out of the compartment when the container is tilted.

BRIEF DESCRIPTION OF THE INVENTION

The present invention provides an improved container for dispensing a liquid beverage and a consumable food, preferably a particulate food which is dry and flowable, simultaneously. One combination of liquid beverage and food that can be dispensed simultaneously is milk and cereal. Other combinations could be cheese snacks and soda, pretzels and beer, etc.

The container of the present invention includes an outer cup, an inner cup nested in the outer cup and a lid that closes the outer cup and retains the inner cup with respect to the outer cup. In the preferred embodiment, the lid interlocks with the outer cup. In use, the liquid beverage can be added to the outer container and then the inner container with the consumable food can be inserted into the outer cup. In one embodiment, the lid is integral with the inner cup and in another the lid is separate from the inner cup. The lid has a dispensing opening that is in fluid communication with the outer cup and a vent hole to facilitate even fluid flow. When the cup is tilted, the liquid and food can be simultaneously poured from the container.

The container can be marketed with the beverage and the food pre-filled in the container. In this way, the container is simply opened by peeling off or back a label on the lid, and used by the consumer. Another method of marketing the container is to have the inner cup pre-filled and sealed in the inner cup. The consumer then would add the liquid to the outer container and insert the inner container. Again the lid would interconnect the inner and outer cups and provide the dispensing opening. A third alternative would be to pre-fill the outer cup and allow the consumer to fill the inner cup. A still further alternative would be to allow the consumer to fill both cups.

The outer cup has a mouth, bottom and body. The body is generally defined by a cross-section having first and second sides. A flat portion generally defines the first side of the body and an arcuate or curved portion generally defines the second side of the body. A small flat area is generally opposite the flat portion of the body. This shape provides an ergonomic design that is very comfortable for the user. It also provides a quick method of orientation of the cup by the user.

The inner cup has a body portion defining a cavity, top portion and a bottom portion. The inner cup is defined by a plurality of walls with the walls sloping from the bottom portion to the top portion to create a unique cone shape to provide controlled discharge of food or channeling from the inner cup. One difficulty with dispensing dry materials is that the material can bridge or plug which inhibits or prevents flow. As the user tries to get the food to flow, the flow can release in an uncontrolled fashion once the bridge is lost resulting in food spilling out. An example is when a potato chip bag is tilted to get the last of the chips. At first the chips can be blocked, and then when the block is removed they spill over the person. The shape of the inner cup reduces and can even prevent the bridging or plugging problem. In the disclosed embodiment, the inner cup includes eight walls. It should be understood that less or more walls could be used to provide the desired controlled discharge of food from the inner cup.

The eight walls include a first arcuate wall or back region, said first arcuate wall is concave with respect to the cavity. Second and third walls extend from the first wall. By way of definition, the second and third walls have been included in the definition of the back region in describing the invention. The second and third walls curve in a convex direction with respect to the cavity. Fourth and fifth walls extend from the second and third walls respectively and sixth and seventh walls extend from the fourth and fifth walls respectively. These walls have for definitional positions been defined as the side region of the inner cup. The fourth and fifth walls of the disclosed invention are slightly curved in the convex direction with respect to the cavity. The sixth and seventh walls curve in the concave direction with respect to the cavity. An eighth wall joins the sixth and seventh walls and by way of definition defines the discharge region of the inner cup. All the walls of the preferred embodiment are angled inwardly along the longitudinal axis of the inner cup between the bottom portion and top portion to define the cone shape. Overall, the shape of the cavity of the inner cup is generally v-shaped, with the narrow end of the "v" being at the discharge region.

The unique design of the inner cup provides numerous benefits to the consumer. The shape of the inner cup directs the contents of the cup to the discharge region. The discharge region is small in width when compared to the remainder of the inner cup. By narrowing the discharge region, the food discharge is controlled, but available as long as food remains in the cavity. The wider remaining portion of the inner cup continually provides food to the discharge area to control its further movement. Additionally, the walls are shaped to continually direct the food to the discharge region. The shape of the walls facilitates continual flow of material to the discharge region. Still further, the design reduces and even eliminates bridging or plug flow.

The inner cup exterior is generally shaped to mate with the inside of the outer cup. This ensures proper orientation.

A lid is provided to close the outer cup and to hold the inner cup in the outer cup and precisely channel both liquid and food for easy simultaneous consumption. In one embodiment, the lid is formed integral with the inner cup and locks to the outer cup. In another embodiment, the lid is separate from the inner cup. With the separate lid, the lid locks to the outer cup and engages the inner cup to hold the inner cup in position within the outer cup. In both embodiments, the lid precisely channels the liquid and food for simultaneous consumption The lid has a locking flange and a raised rim. The locking flange has the general shape of the outer cup cross section so that it can be quickly and easily positioned on the outer cup. This facilitates overall orientation of the container's components. The locking flange engages the outer cup to lock the lid to the outer cup with the inner cup positioned in the outer cup. The lid closes off the open portion of the outer cup and provides a partially closed seal for the space created between the inner and outer cup. It is only partially closed because of the dispensing hole and vent hole. For use, these could initially be closed with an adhesive seal until the container is to be used The raised rim is generally an inverted u-shaped and is defined by a generally flat upper surface, an inner surface and an outer surface. The raised rim includes an opening in communication with the space between the inner and outer cups for the discharge of liquid from within the space. In the disclosed embodiment, the inner surface of the raised rim is shaped to compliment the inner walls of the inner cup, i.e. eight walls defining the back, side and discharge regions. As should be understood, the number of inner surface walls could change. There could be more or less walls depending upon the desired discharge control and the food being used.

The raised rim includes a discharge opening to discharge liquid from the space between the inner and outer cups. This raised rim slopes from the discharge opening with the outer and inner surfaces of the rim being longest adjacent the discharge opening. The slope is designed to allow a consumer to tilt the container without having to tilt the user's head. This allows the user to use the container without changing the user's line of sight.

In all previous attempts to create a single handed container that allows simultaneous consumption of liquids and particulates, liquid spills and drips were a significant issue for the user. Spilled milk is a problem on clothing or in the car. To overcome this problem, the raised rim also includes a unique indent formed in the outer surface of the rim closely adjacent the dispensing hole. The indent defines an edge along the side wall of the rim even with the flat upper surface of the raised rim. The edge in the desired embodiment extends outwardly from the flat surface and forms an acute angle with respect to the outer wall of the raised rim. The acute angle together with the indent of the preferred embodiment is generally arc shaped to form a comfortable and effective resting surface for the user's lower lip and reduces liquid spills.

The edge provides two important advantages. First, the edge creates surface tension on any liquid left on the dispensing region so that it does not drip on the user. Liquid will tend to flow back into the dispensing hole instead of dripping on a user. Second, the edge provides a wipe feature so that the user can wipe his or her lip during use. For example, in the event a small amount of liquid is on the user's lip, the user can wipe the edge over the lip to remove the liquid.

These and other features and advantages of this invention will become more apparent to those skilled in the art from the following detailed description and the accompanying drawings. The drawings that accompany the detailed description are described below.

DETAILED DESCRIPTION

Figure 1:
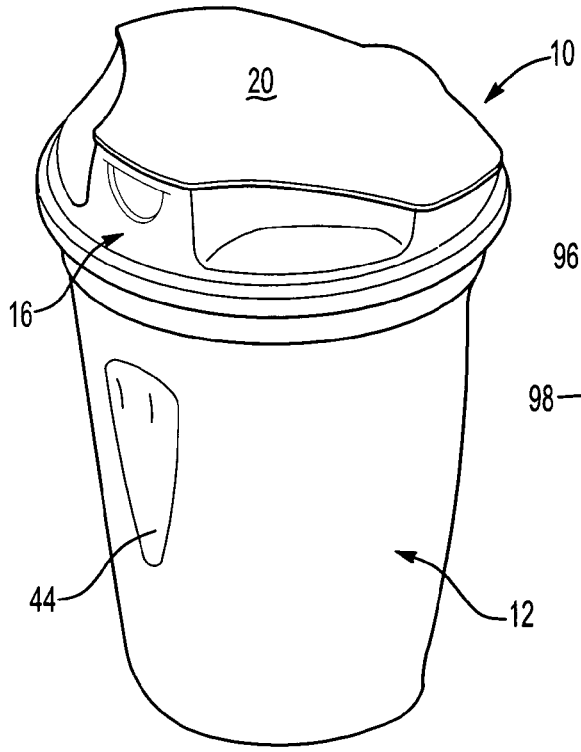
FIG. 1 is a perspective view of one embodiment of the container of the present invention with the top sealed.

With reference to FIG. 1, the single handed container for mixing foods of the present invention is shown generally at 10. As illustrated, the container 10 has an outer cup 12 and an inner cup 14, see FIG. 3. The inner cup 14 fits into the outer cup 12 and includes a lid 16 that seals the inner cup 14 to the outer cup 12. In this embodiment, the lid 16 is integral with the inner cup 14. As will be described in more detail below, the inner cup 14 fits within the outer cup 12 to form a space 18 between the inner 14 and outer 12 cup; see FIGS. 3 and 5. In the preferred embodiment, the inner cup 14, outer cup 12 and lid 16 are made of polypropylene, but numerous other materials could be used, such as paper, Styrofoam, glass, etc.

Figure 2:
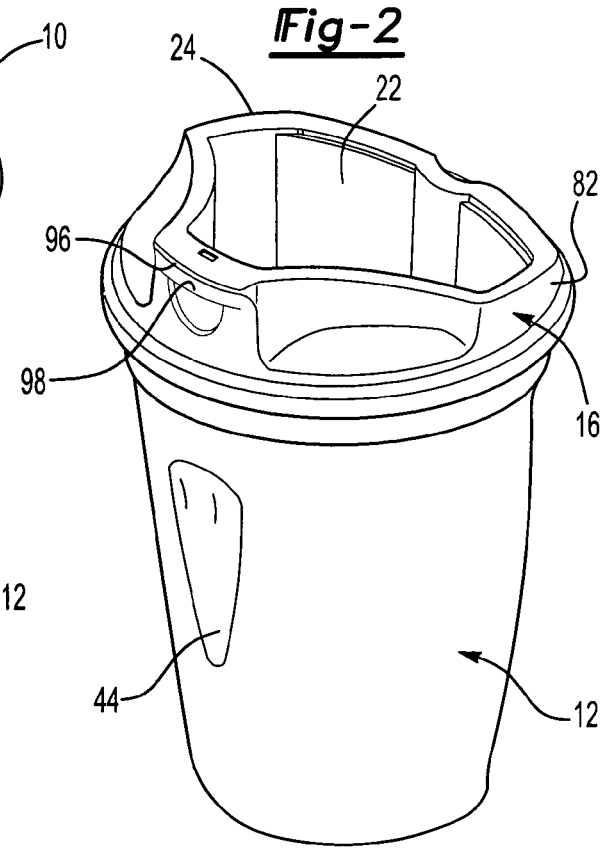
FIG. 2 is a perspective view of the embodiment of FIG. 1 with the seal on the container being removed.

In the disclosed invention, a removable seal 20 is fixed to the inner cup 14. As illustrated in FIG. 2, the removable seal 20 seals the cavity 22 of the inner cup 14 and in particular its contents and the dispensing opening 88 and vent hole 90. In the disclosed embodiment, the seal 20 has an adhesive to adhere the seal 20 to the surface 24 of lid 16. It will be appreciated by those of ordinary skill in the art of packaging that numerous different seals could be used to seal the cavity 22. It is to be understood that the invention is not limited to a particular type or method of sealing. In addition to the seal 20, tapes, overwraps, shrink bands to name just a few, which can be tamper evident, can be placed around the lid 16 and the perimeter of the inner cup 14 to seal the lid 16 to the outercup 14, if desired. For example, if pretzels are prefilled into the inner cup with seal 20 to preserve freshness and the filled inner cup is placed into an empty outer cup, it would be preferable to place a tamper evident seal on the inner cup and outer cup connection so users would be assured that the outer cup is sanitary. Further, it may be desirable to overwrap empty single handed containers to provide consumers a tamper evident seal ensuring cleanliness and overall sanitation.

Figure 5:
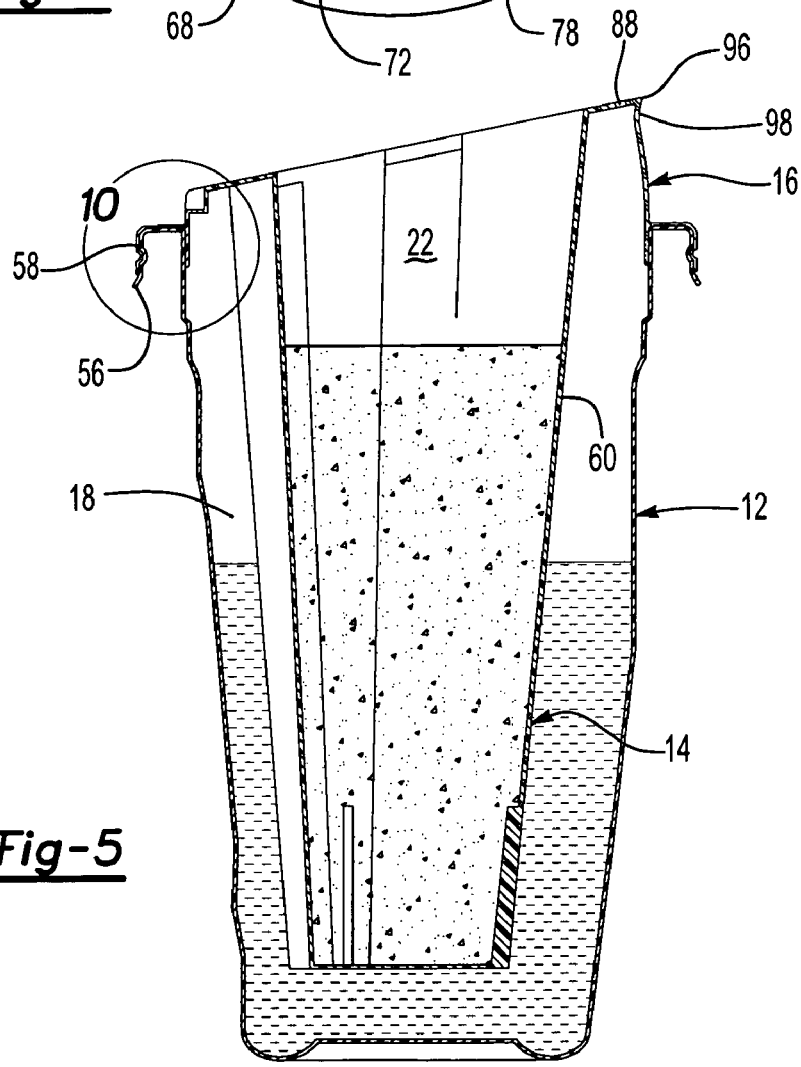
FIG. 5 is a view taken along line 5—5 of FIG. 4.
Figure 6:
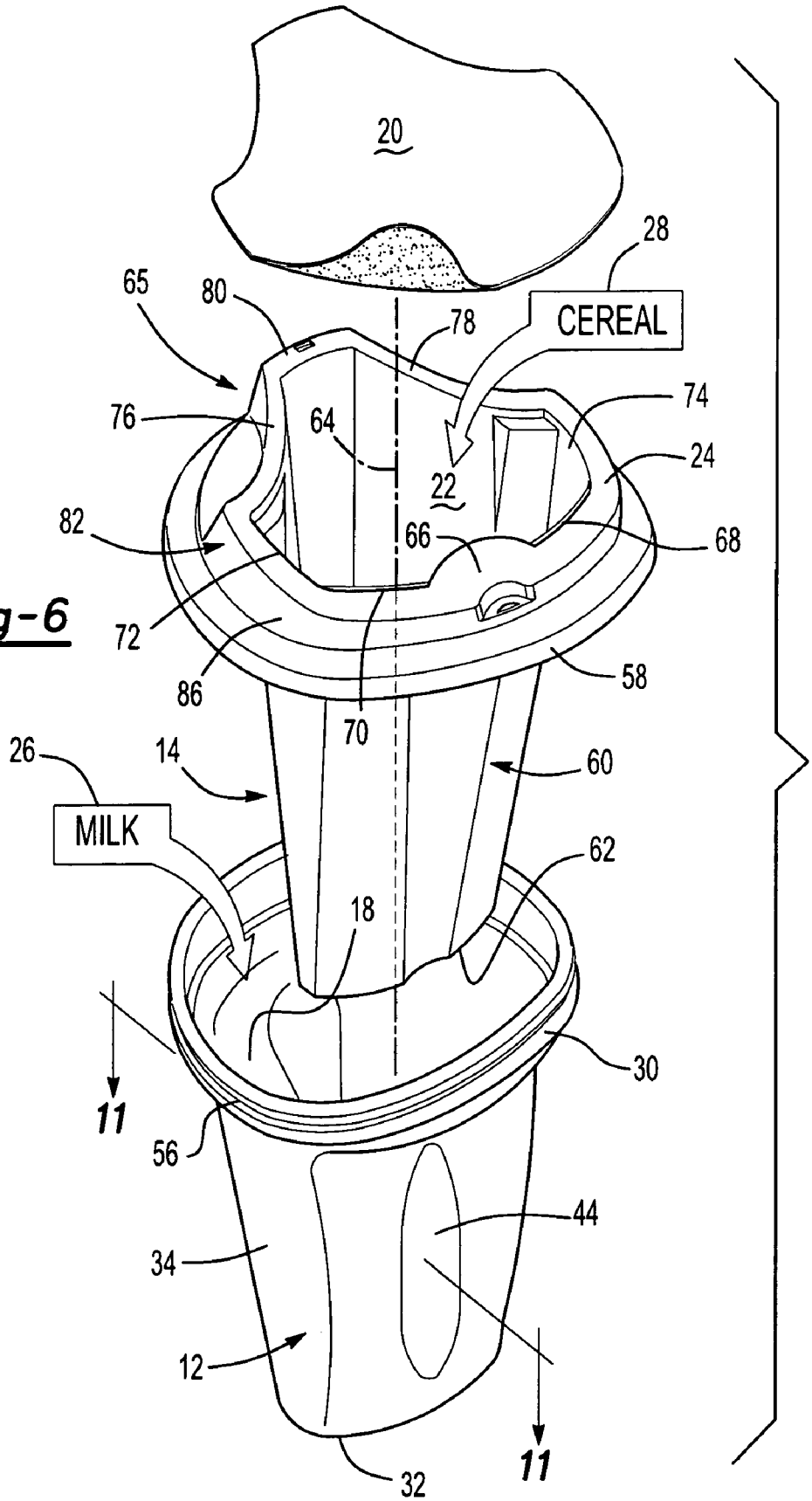
FIG. 6 is an exploded view of the container of FIG. 1.

With reference to FIGS. 5 and 6, a first embodiment of the present invention is illustrated. As can be seen, a liquid 26, such as for example milk as shown, or soda, beer, etc. is poured into the space 18. In the preferred embodiment, the space 18 is designed to hold ½ pint of liquid or roughly 10 ounces, but could be designed to hold any desired quantity of liquid 26, for example the amount could be about 4 ounces to 40 ounces, etc. Then inner cup 14 fits into the outer cup 12. The inner cup 14 in the disclosed embodiment contains a food 28, such as for example cereal as shown, or peanuts, pretzels, potato chips, etc. As indicated above, cavity 22, dispensing opening 88 and vent hole 90 are preferably sealed by seal 20. In the disclosed embodiment, the inner cup holds about 30 to 60 grams of low bulk density particulate food, but any amount could be used.

Figure 7:
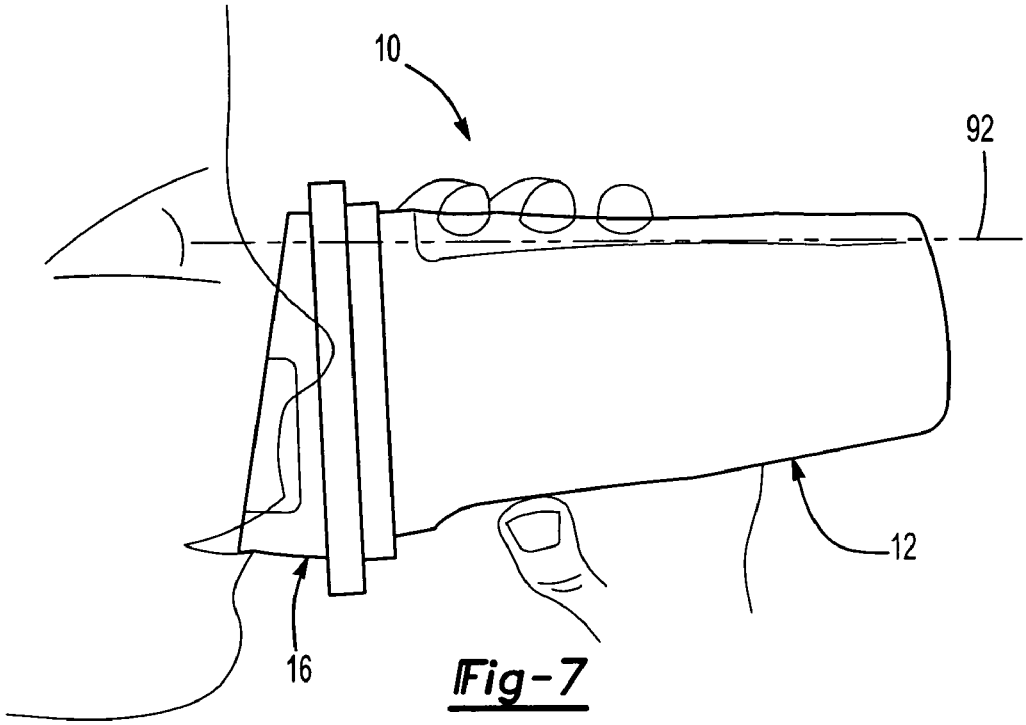
FIG. 7 is a side view of a consumer using the container of the present invention.
Figure 8:
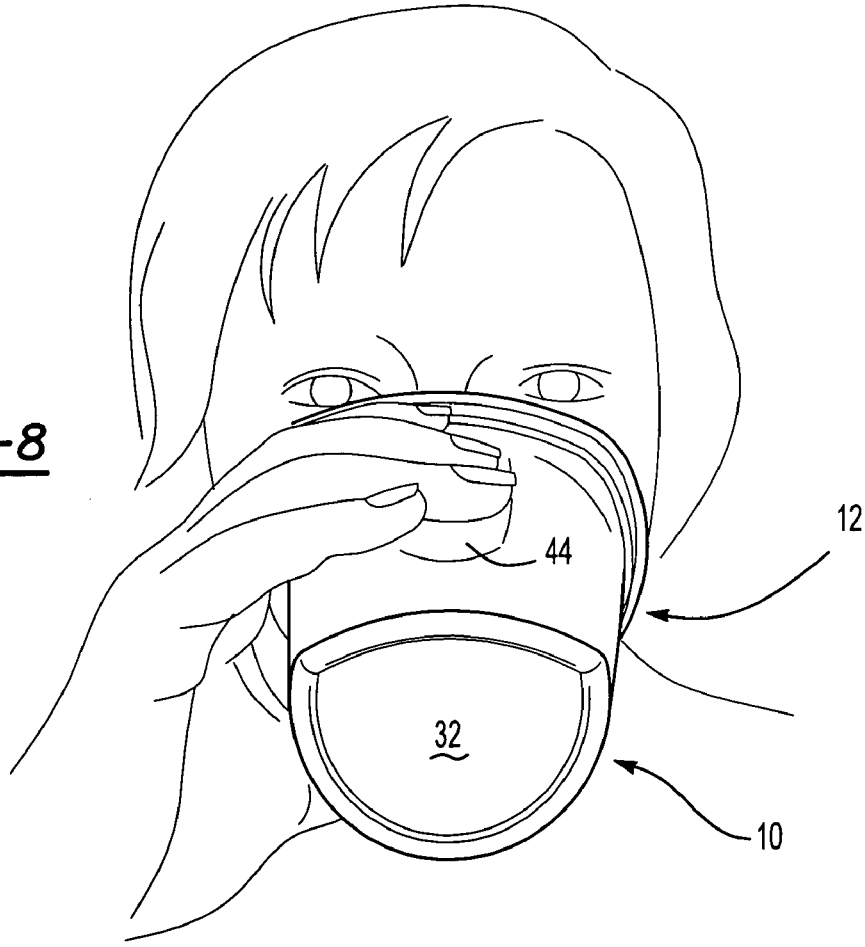
FIG. 8 is a front view of a consumer using the container of the present invention.
Figure 9:
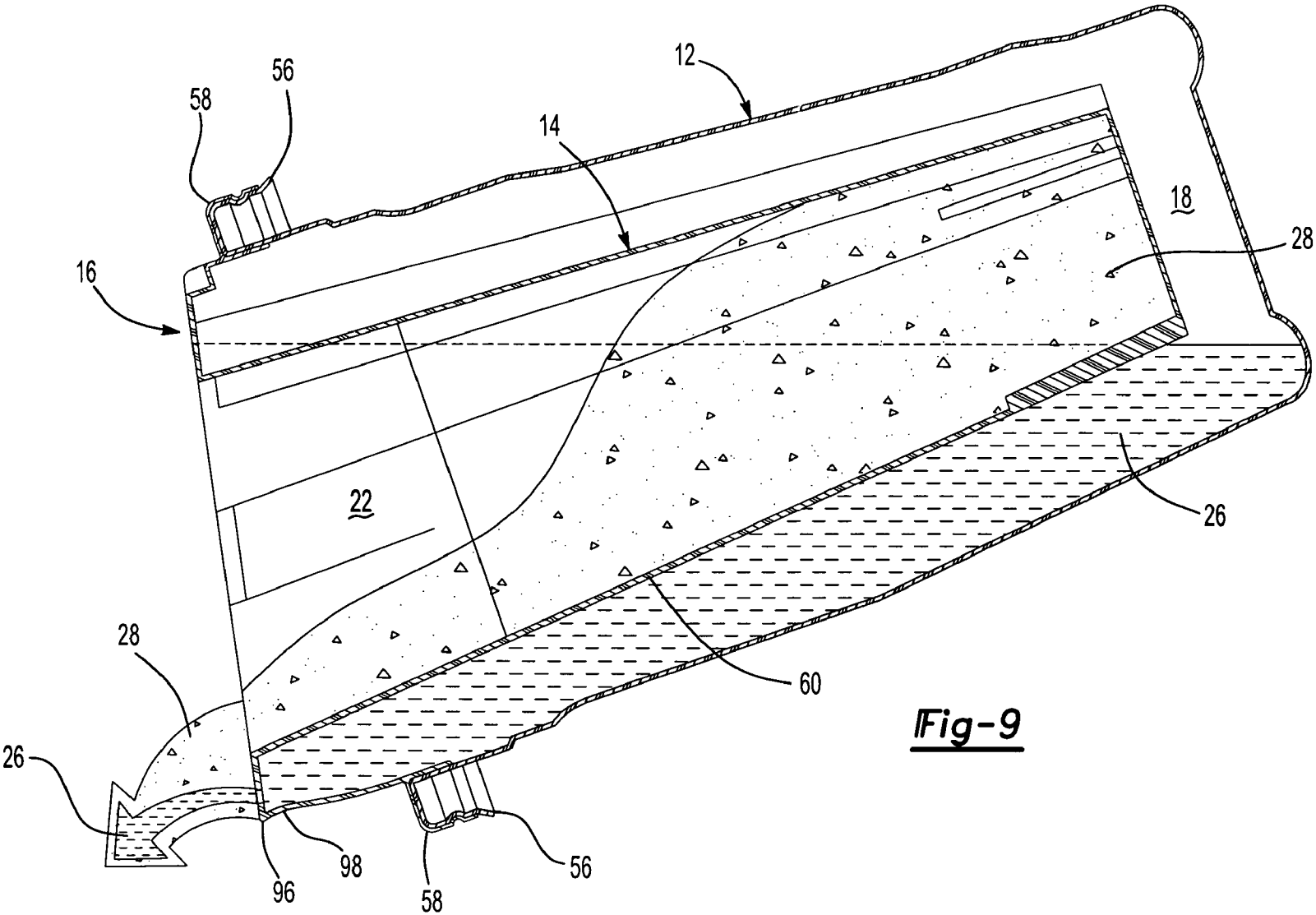
FIG. 9 is a cutaway view of the container of claim 1 showing the flow of liquid and consumable food.
Figure 10:
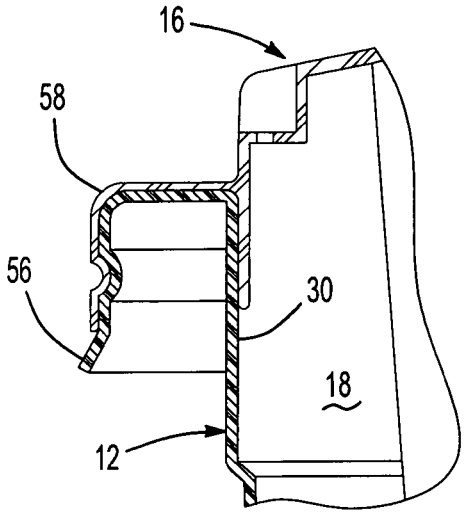
FIG. 10 is a exploded view of FIG. 5 showing the locking flange and mating flange of the present invention which provides a double interference seal to give a water tight seal.

In use, the container 10 can be sold with the liquid 26 and food 28 pre-filled so that the user merely removes the seal 20 and if used, a tamper evident seal and then consumes the food and liquid as illustrated in FIGS. 7, 8 and 9. Or the container can be sold with the outer cup 12 empty and the inner cup 14 filled and sealed. The consumer would then fill the outer cup 12 with liquid 26 and assemble the inner cup 14 to the outer cup 12. The seal 20 can be removed and the two products consumed as illustrated in FIGS. 7, 8 and 9. In another method of use, the consumer could fill both the inner cup 14 and the outer cup 12.

With reference to FIGS. 7, 8, and 9, and particularly with reference to FIG. 9, the consumption of food and liquid is illustrated. As can be seen, when the cup 10 is tilted, the liquid 26 and the food 28, flow out of space 18 and the cavity 22 and generally simultaneously enter the consumers mouth. In this way, the consumer receives the crisp dry food and liquid joined at the time of consumption, much the same as eating for example cereal and poured milk from a bowl with a spoon. Obviously, the consumer can easily control the amount of liquid and food received by manipulating his or her mouth and tongue on the lid 16. Depending upon how much the consumer opens his or her mouth and/or tongue will determine the relative amount of food 28 and liquid 26 received at a given time. Another important advantage of the present invention is that it solves the traditional serving time problem encountered with ready to eat cereals that are eaten with a spoon from a bowl with poured milk. Normally, ready to eat cereal can lose some of its crispness when it stays in milk for a long period of time. Since cereal of the present invention is not in the milk, there is no serving time problem.

The inner cup 14 and outer cup 12 of the present invention are uniquely designed to facilitate use of the container 10. The outer cup 12 is uniquely configured to facilitate handling by the consumer and the inner cup 14 is uniquely configured to facilitate the discharge of food 28 upon tilting of the container 10. Additionally, the lid 16 is configured to prevent dripping of liquid onto the user or the surroundings. The lid combines the use of an acute angle and a cut away or indented area for the user's lower lip which is effectively self cleaning of errant liquids during normal use of the container and to facilitate use without the obstruction of the consumer's vision. This last feature is shown best in FIGS. 7 and 8. These unique designs will discussed in greater detail below.

Figure 11:
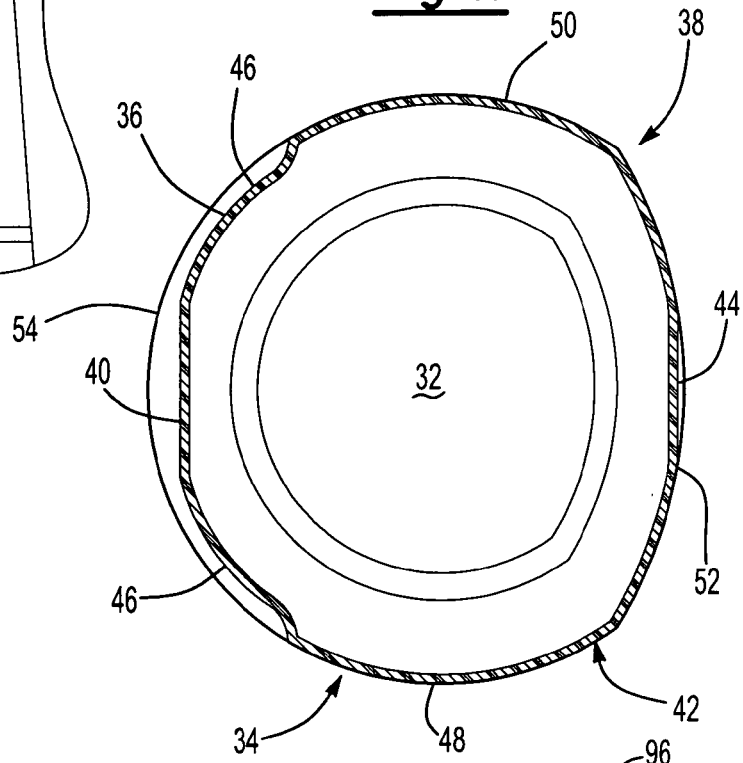
FIG. 11 is a view taken along line 11—11 of FIG. 6.

The outer cup 12 has a mouth 30, bottom 32 and body 34. With reference to FIG. 11, the body 34 is ergonomically designed and is generally defined by a cross-section having first 36 and second sides 38. A flat area 40 generally defines the first side 36 of the body 34 and an arcuate area 42 generally defines the second side 38 of the body 34. The second side 38 also includes a small flat area 44 generally opposite the flat area 40. In the preferred embodiment, the flat area 40 is joined to the arcuate area 42 by a curved area 46. Additionally, in the preferred embodiment, the arcuate area 42 is defined by three curved sections, two opposed sections 48 and 50 and a less curved section 52. As illustrated in FIGS. 9 and 11, the body 34 widens at 54 to merge the body 34 into the mouth 30.

The mouth 30 of the outer cup 12 includes a locking flange 56 for locking the lid 16 to the outer cup 12. The lid 16 has a mating flange 58 that mates with the locking flange 56 to make a fluid tight seal with respect to space 18. In the disclosed embodiment, the flanges 56 and 58 are a double interference seal and provide a compression type seal. As will be appreciated by those of ordinary skill in the art, the locking flange 56 and mating flange 58 could be made from various other configurations other than the one example shown.

As should be appreciated, the outer cup 12 is ergonomically designed to comfortably fit a consumer's hand and to permit easy orientation of the inner cup 14 with the outer cup 12 and easy orientation of the opening 88 to the user's mouth.

Figure 4:
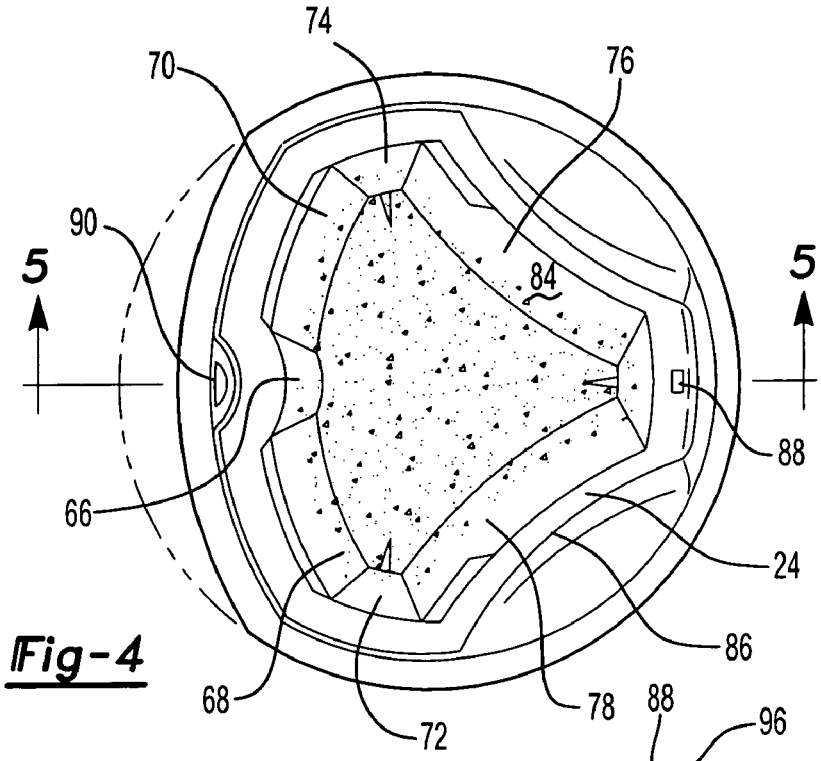
FIG. 4 is a top view of the container of FIG. 2.

The inner cup 14 has a body portion 60 defining cavity 22, top portion 65 and a bottom portion 62. In the preferred embodiment, the body 60 of inner cup 14 is defined by eight side walls, see FIGS. 4 and 6. A first curved wall 66 that is generally concave with respect to the cavity 22. Second and third walls 68 and 70 extend from the first wall 66. The walls 66, 68 and 70 combine to define the back region of the inner cup 14. The second and third walls 68 and 70 are curved in a convex direction with respect to cavity 22. Fourth and fifth walls 72 and 74 extend from the second and third walls 68 and 70 respectively. The fourth and fifth walls 72 and 74 are curved in a convex direction with respect to cavity 22. Sixth and seventh walls 76 and 78 extend from the fourth and fifth walls 72 and 74 respectively and are cured in a concave direction with respect to the cavity 22. The walls 72,74,76, and 78 combine to define the side regions of the inner cup 14. The eighth wall 80 joins the sixth and seventh walls 76 and 78. The eighth wall defines the discharge region of the inner cup 14. All of the walls 66–80 slope inwardly along the longitudinal axis 64 from the bottom 62 to the top portion 65. The top portion 65 is larger in diameter than the bottom 62. This unique configuration provides superior non-bridge flow of the food particulates and controlled channel flow.

Figure 3:
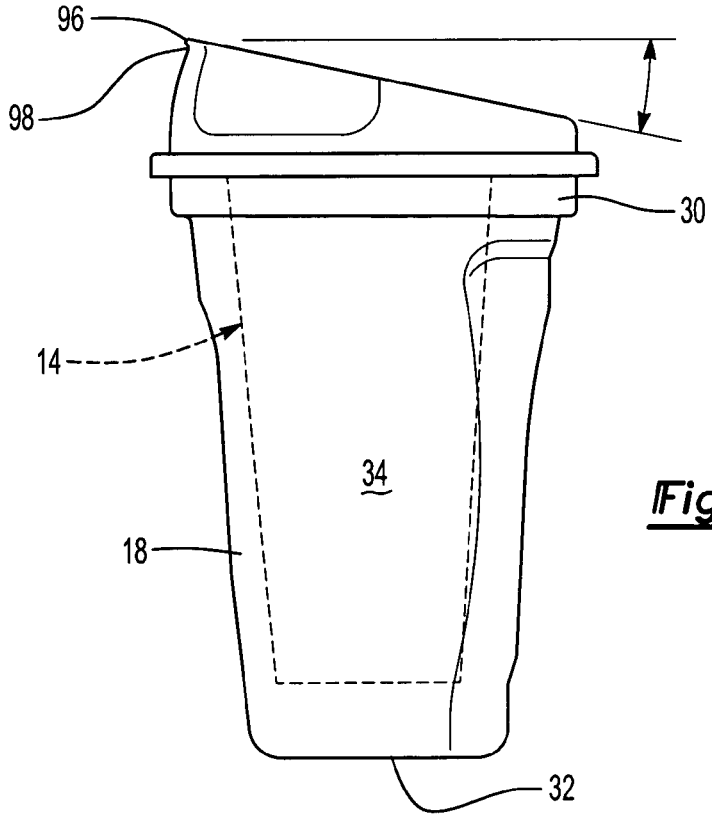
FIG. 3 is a side view of the container of FIG. 1.

The lid 16 includes the mating flange 58 and a raised rim 82. In the disclosed embodiment, the raised rim 82 has the same general shape as body portion 60 of the inner cup 14. The raised rim 82 is generally an inverted u-shape, see FIG. 5. Rim 82 is defined by a generally flat upper surface 24, inner walls 84 and an outer wall 86. The flat upper surface 24 has an opening 88 in communication with the space 18 of the outer cup 12 and a vent opening 90 also in communication with the space 18 of the outer cup 12. As illustrated in FIGS. 3 and 7, the rim 82 slopes from the opening 88 in the direction of the vent opening 90. The preferred angle of slope is 12°, but could be about 5° to 30°.

With reference to FIGS. 2, 3, 9 and 13, the edge 96 is illustrated. The edge 96 is defined by indent 98 which forms an acute angle between the flat upper surface 24 and the outer wall 86. With the natural surface tension of liquids the acute edge causes the liquid to bead in a more pronounced manner on the top portion of the rim and not flow onto the outer surface of the lid. If the liquid flows onto the outer surface of the lid or even further onto the exterior surface of the outer cup, the liquid could make a mess on the user's clothing or surrounding surfaces. The indented area immediately adjacent to the acute angle provides for a better seal between the user's lower lip and the container which further prevents spills. Due to the undercut nature of the indent, as the consumer begins to remove the container from the mouth the lip naturally wipes the lid at the acute angle further removing droplets of liquid. This motion provides for a self clean action on the lid significantly reducing liquid spills. The indent 96 is preferably arc shaped and provides a comfortable place for the user's lower lip.

As illustrated in FIGS. 7 and 8, the sloped rim 82 and the shape of the cavity 24 which is defined by the walls 66–80 allows a user to fully tilt the container 10 for discharging the entire contents of the container 10 without the user's head having to significantly tilt. This allows the user to empty the contents of the container 10 without interfering with the user's line of sight 92. Additionally, the inner walls 84 of rim 82 define a generally v-shaped opening which permits the user's nose to enter the cavity 22. This also facilitates the user being able to tilt the container 10 without tilting the user's head.

Figure 13:
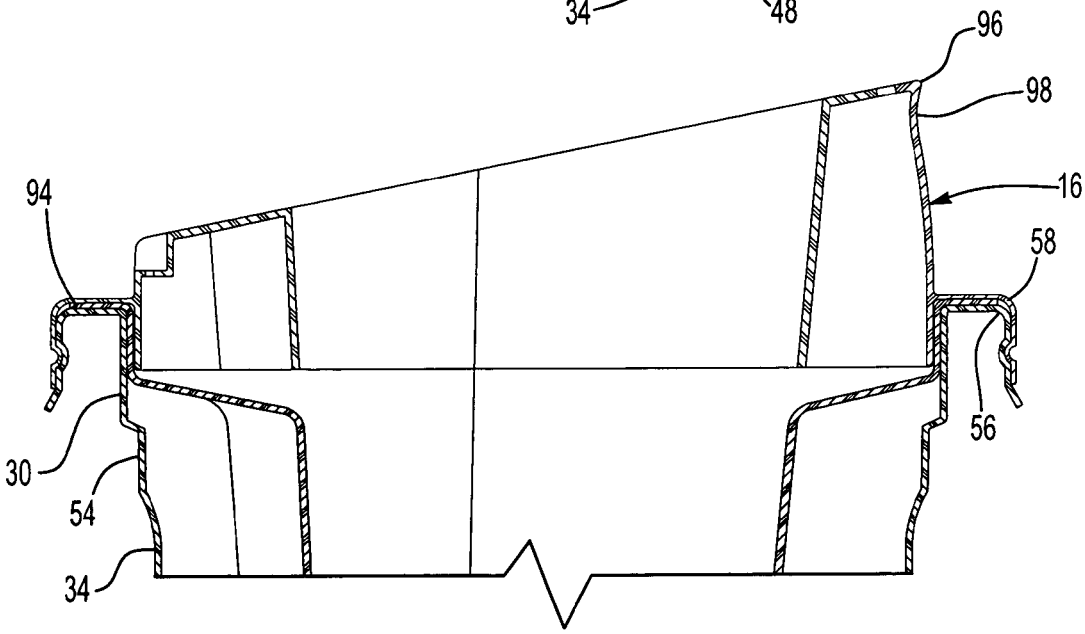
FIG. 13 is a partial cutaway view of the container of claim 12.
Figure 12:
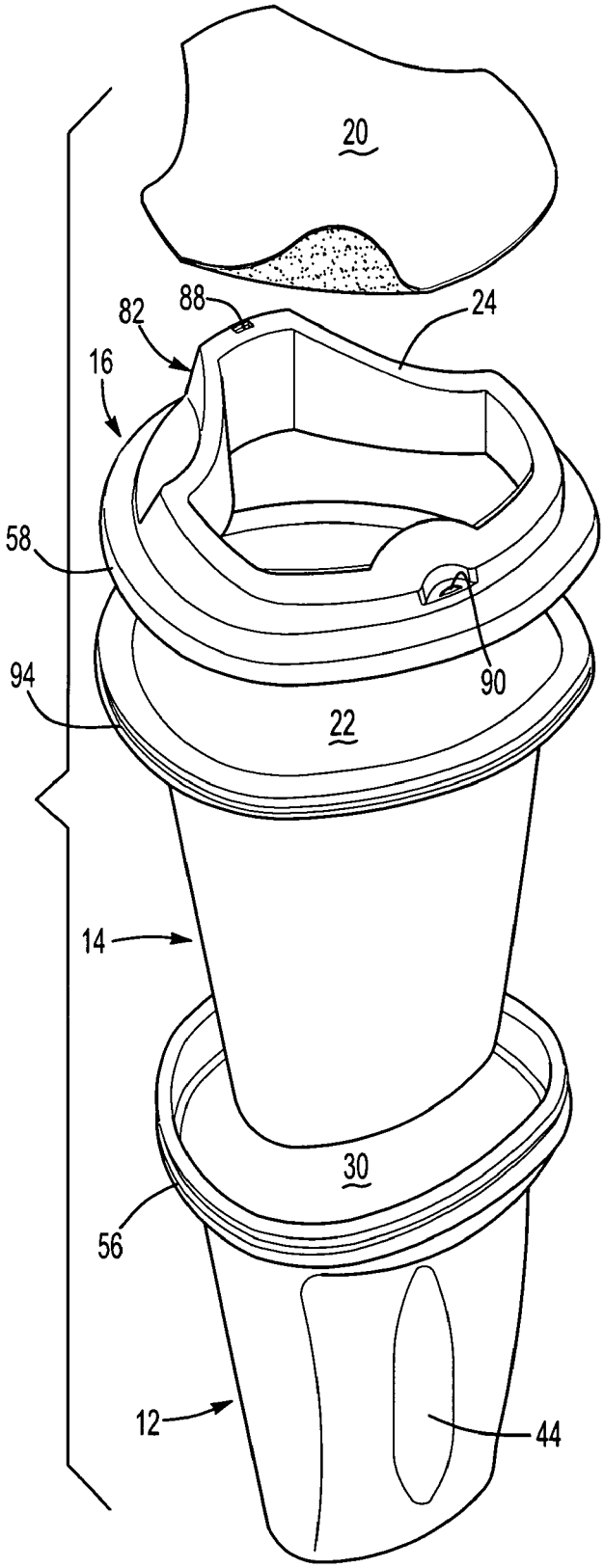
FIG. 12 is an exploded view of a further embodiment of the present invention.

With reference to FIGS. 12 and 13, a further embodiment of the present invention is illustrated. In this embodiment, the same numbers will be used for the same elements. The difference between this embodiment and the previous embodiment is that the inner cup 14 is not integrally formed to the lid 16 in this embodiment. In this embodiment, the inner cup 14 has a lip 94 that is captured between the locking flange 56 and the mating flange 58. In this embodiment, the inner cup 14 is inserted into the outer cup 12 and then the lid 16 is snapped on.

Figure 14:
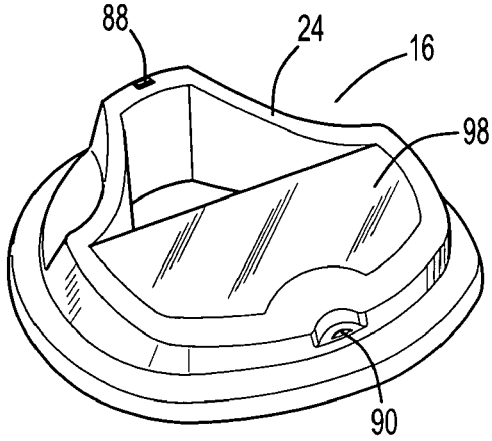
FIG. 14 is a further embodiment illustrating the flow restrictor of the present invention.

With reference to FIG. 14, a flow restrictor 98 is illustrated. The flow restrictor 98 further facilitates the channeling of food particulate to the user. With the flow restrictor 98 the flow path is further channeled to the dispensing region of the inner cup. As should be appreciated, the flow restrictor is optional and could be used on either embodiment. Additionally, the flow restrictor could be integrally formed or removable.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A container for containing a consumable liquid beverage and a consumable food, said container comprising:

an outer cup having a mouth, bottom and body;

an inner cup having a body portion defining a cavity, top portion and a bottom portion, said inner cup being defined by a plurality of walls, said walls sloping from said bottom portion to said top portion;

a lid having an open central space which is generally v-shaped, a locking flange and a raised rim, said locking flange having the general shape of said outer cup cross section, said locking flange engaging said outer cup to lock said lid to said outer cup with said inner cup being positioned in said outer cup;

said inner cup and outer cup defining a space between said inner and outer cups adapted for receipt of the consumable liquid beverage;

said raised rim is generally an inverted u-shaped in cross section and is defined by a generally flat upper surface, an inner surface and an outer surface, said inner surface defining a central opening, said raised rim including a small discharge opening in communication with said space for the discharge of liquid from within said space, said central opening being narrow at said small discharge opening and widening out from adjacent said small discharge opening, said raised rim slopes from said small discharge opening with said outer and inner surfaces of said rim are longest adjacent said small discharge opening;

said raised rim and said central opening are adapted to permit the user to tilt and empty the contents of the container reducing tilting of the user's head.

2. The container of claim 1, wherein said second side includes a small flat area generally opposite the flat area which defines the first side, said small flat area providing for quick orientation of said container with respect to a user.

3. The container of claim 1, wherein said body is generally defined by a cross-section having first and second sides, a flat area generally defines the first side of the body and an arcuate area generally defines the second side of said body.

4. The container of claim 1, wherein said inner cup includes eight walls.

5. The container of claim 1, wherein said body portion being defined by eight walls, a first arcuate wall, said first arcuate wall being concave with respect to said cavity, second and third walls extending from the first wall, said second and third walls curving in a convex direction with respect to said cavity, fourth and fifth walls extending from said second and third walls respectively, sixth and seventh walls extending from said fourth and fifth walls respectively, said sixth and seventh walls curving in a convex direction with respect to said cavity and an eighth wall joining said sixth and seventh walls.

6. The container of claim 4, wherein said inner cup includes a longitudinal axis, said walls being angled inwardly along the longitudinal axis between said bottom portion and said top portion.

7. The container of claim 1, wherein said lid is integrally formed to said inner cup.

8. The container of claim 1, wherein said lid is separate from said inner cup.

9. The container of claim 1, wherein said inner cup has at least a dispensing region, a back region and side regions interconnecting said beverage dispensing region and said back region.

10. The container of claim 1, further including a vent hole.

11. The container of claim 1, wherein said inner surface of said rim is defined by a plurality of surfaces.

12. The container of claim 1, wherein said inner surface of said rim has at least a dispensing region, a back region and side regions interconnecting said dispensing region and said back region.

13. The container of claim 1, wherein said raised rim has the same general profile as said body portion inner cup.

14. The container of claim 1, further including an edge adjacent said discharge opening.

15. The container of claim 14, wherein said edge is defined by an acute angle formed by a recess in said outer surface, said recess is generally arcuate, whereby a user can comfortably rest a lower lip on said recess and wipe the lips across said edge to reduce drips.

16. The container of claim 1, further including a flow restrictor.

17. The container of claim 1, wherein said raised rim has eight inner surfaces, a first arcuate surface, said first arcuate surface being concave with respect to said cavity, second and third surfaces extending from the first surface, said second and third surfaces curving in a convex direction with respect to said cavity, fourth and fifth surfaces extending from said second and third surfaces respectively, sixth and seventh surfaces extending from said fourth and fifth surfaces respectively, said sixth and seventh surfaces curving in a convex direction with respect to said cavity and an eighth surface joining said sixth and seventh surfaces.

* * * * *